US009046320B2

(12) United States Patent
Keng et al.

(10) Patent No.: US 9,046,320 B2
(45) Date of Patent: Jun. 2, 2015

(54) SYSTEMS, METHODS, AND APPARATUS FOR PROVIDING A FIREARM SIGHT

(71) Applicant: Keng's Firearms Specialty, Inc., Atlanta, GA (US)

(72) Inventors: Da Keng, Smyrna, GA (US); Aaron L. Hampton, Columbus, GA (US); Maciej W. Matuszczak, Woodstock, GA (US)

(73) Assignee: Keng's Firearms Specialty, Inc., Atlanta, GA (US)

( * ) Notice: Subject to any disclaimer, the term of this patent is extended or adjusted under 35 U.S.C. 154(b) by 0 days.

(21) Appl. No.: 14/097,671

(22) Filed: Dec. 5, 2013

(65) Prior Publication Data

US 2014/0150325 A1 Jun. 5, 2014

Related U.S. Application Data

(60) Provisional application No. 61/733,687, filed on Dec. 5, 2012, provisional application No. 61/733,688, filed on Dec. 5, 2012.

(51) Int. Cl.

| | |
|---|---|
| ***F41G 1/30*** | (2006.01) |
| ***F41G 11/00*** | (2006.01) |
| *F41G 1/00* | (2006.01) |

(52) U.S. Cl.

CPC ... *F41G 1/30* (2013.01); *F41G 1/00* (2013.01); *Y10T 29/49826* (2015.01); *F41G 11/003* (2013.01)

(58) Field of Classification Search

USPC ..... 42/118, 90, 127, 128, 132, 135–137, 42/140, 144–145, 147, 148

See application file for complete search history.

(56) References Cited

U.S. PATENT DOCUMENTS

| | | | | |
|---|---|---|---|---|
| 7,814,698 | B2 | 10/2010 | Fluhr et al. | |
| 7,814,699 | B2 * | 10/2010 | Storch et al. | 42/137 |
| 7,908,782 | B1 | 3/2011 | LaRue | |
| 7,946,074 | B2 * | 5/2011 | Nemec | 42/137 |
| 8,015,744 | B1 * | 9/2011 | Swan | 42/147 |
| 8,468,735 | B1 * | 6/2013 | Keng et al. | 42/148 |
| 8,490,313 | B2 * | 7/2013 | Frascati et al. | 42/90 |
| 8,769,859 | B2 * | 7/2014 | Li et al. | 42/124 |

(Continued)

FOREIGN PATENT DOCUMENTS

| | | | |
|---|---|---|---|
| JP | 2012-202573 | A | 10/2012 |
| KR | 10-1171615 | B1 | 8/2012 |

OTHER PUBLICATIONS

Search Report and Written Opinion for International Application No. PCT/US2013/073321 mailed Mar. 18, 2014.

(Continued)

*Primary Examiner* — Michael David

(74) *Attorney, Agent, or Firm* — Sutherland Asbill & Brennan LLP

(57) ABSTRACT

A firearm sight is disclosed herein. The firearm sight may include a main body assembly, a first plate assembly operably attached to the main body assembly, and a second plate assembly operably attached to the main body assembly opposite the first plate assembly. A sight assembly may be operably attached to the main body assembly between the first plate assembly and the second plate assembly. Moreover, a deployment mechanism may be operable to deploy the first plate assembly, the second plate assembly, and the sight assembly from a closed position to an open position.

16 Claims, 8 Drawing Sheets

(56) References Cited

U.S. PATENT DOCUMENTS

| | | | | |
|---|---|---|---|---|
| 8,898,949 | B1 * | 12/2014 | Greenwood | 42/90 |
| 2005/0188602 | A1 | 9/2005 | Swan | |
| 2006/0162227 | A1 * | 7/2006 | Samson | 42/148 |
| 2008/0034638 | A1 | 2/2008 | Spuhr | |
| 2008/0276520 | A1 * | 11/2008 | Ballard | 42/143 |
| 2011/0296732 | A1 | 12/2011 | Carlson et al. | |
| 2011/0296734 | A1 | 12/2011 | Troy | |
| 2012/0180368 | A1 | 7/2012 | Haley et al. | |

OTHER PUBLICATIONS

Search Report and Written Opinion for International Application No. PCT/US2013/073323 mailed Mar. 19, 2014.

* cited by examiner

SYSTEMS, METHODS, AND APPARATUS FOR PROVIDING A FIREARM SIGHT

CROSS-REFERENCE TO RELATED APPLICATION

The present application claims priority to and the benefit of U.S. Provisional Patent Application Nos. 61/733,687 and 61/733,688, filed Dec. 5, 2012, which are both hereby incorporated by reference in their entirety.

FIELD OF THE DISCLOSURE

The disclosure generally relates to firearm accessories and more particularly relates to systems, methods, and apparatus for providing a firearm sight.

BACKGROUND

Conventional firearm sights, such reflector-type firearm sights, have been used with firearms to facilitate aiming and to improve shooting accuracy. For example, it is generally recognized that highly visible firearm sights can aid or enhance the effectiveness of aiming a firearm. In some instances, firearm sights that utilize white paint or scintillating fiber can be more visible in ambient lighting conditions than conventional iron sights. Firearm sights that contain tritium may be more visible in darkness but may not be more visible than conventional firearm sights under ambient light. By comparison, reflective dot firearm sights can be more visible in all types of lighting conditions. In many instances, however, conventional reflective dot firearm sights can be relatively bulky due to the presence of a reflective lens. As a result, the size and shape of conventional reflective dot firearm sights can be restrictive, which can adversely affect the deployment and/or aim of the firearm.

SUMMARY

Some or all of the above needs and/or problems may be addressed by certain embodiments of the firearm sight disclosed herein. According to an embodiment, the firearm sight may include a main body assembly, a first plate assembly operably attached to the main body assembly, and a second plate assembly operably attached to the main body assembly opposite the first plate assembly. A sight assembly may be operably attached to the main body assembly between the first plate assembly and the second plate assembly. Moreover, a deployment mechanism may be operable to deploy the first plate assembly, the second plate assembly, and the sight assembly from a closed position to an open position.

Other features and aspects of the firearm sight will be apparent or will become apparent to one with skill in the art upon examination of the following figures and the detailed description. All other features and aspects, as well as other systems, methods, and assembly embodiments, are intended to be included within the description and are intended to be within the scope of the accompanying claims.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

DETAILED DESCRIPTION

Overview

Figure 2:
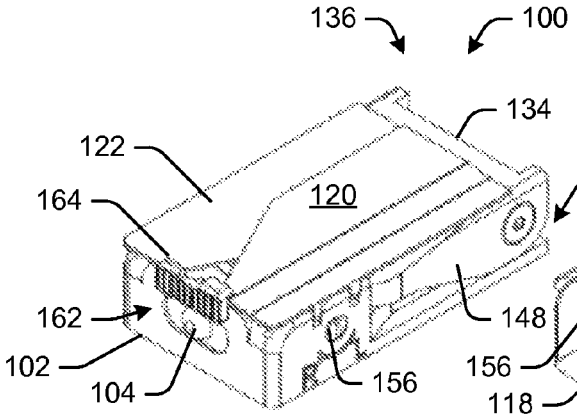
FIG. 2 schematically depicts a firearm sight in accordance with one or more embodiments of the disclosure.
Figure 3:
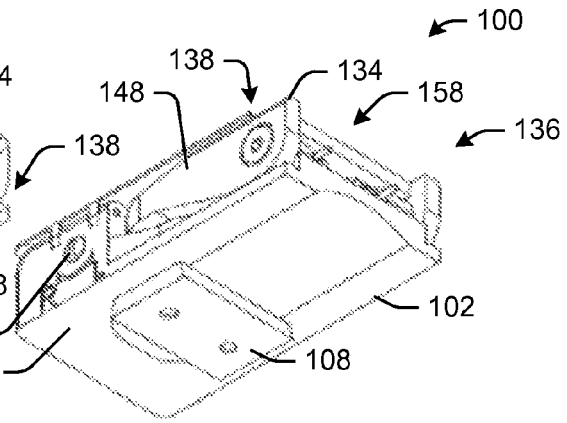
FIG. 3 schematically depicts a firearm sight in accordance with one or more embodiments of the disclosure.

Described below are embodiments of a firearm sight (as well as individual components of the firearm sight) that can be attached to a firearm. Methods of manufacturing, installing, and/or using the firearm sight are also disclosed. In some instances, the firearm sight may function as a primary firearm sight. The firearm may be a conventional firearm. For example, the firearm may be a handgun. In some instances, the firearm may be a rifle, such as an M-16 style rifle, an AR-15 style rifle, an AR-10 style rifle, or an M-4 style rifle, among others. In other instances, the firearm may be a shotgun. Any firearm may be used in association with the firearm sight disclosed herein.

Certain embodiments of the firearm sight can provide the technical effect and/or solution of improved control and stability, resulting in improved firearm accuracy and performance. Moreover, the firearm sight may provide the technical effect and/or solution of improved maneuverability and/or configurability. For example, the firearm sight may be stowed and deployed with relative ease. Other technical effects and/or solutions may become apparent throughout the disclosure.

Generally speaking, the firearm sight may include a main body assembly. The main body assembly may house one or more components of the firearm sight. For example, the main body assembly may include a light source and a power source, among other things.

The main body assembly may be attached to a firearm. For example, a mounting bracket assembly may be used to mount the main body assembly to the firearm. In certain embodiments, the mounting bracket assembly and the main body assembly may be separate components. In other instances, the mounting bracket assembly and the main body assembly may be integral. In some instances, the main body assembly may be directly or indirectly mounted to a slide of a handgun. The main body assembly may be attached to any rail or other attachment point of a firearm.

The firearm sight may include a first plate assembly operably attached to the main body assembly. Moreover, a second plate assembly may be operably attached to the main body assembly opposite the first plate assembly. For example, the first plate assembly and the second plate assembly may be operably attached to opposing lateral sides of the main body assembly. In some instances, the first plate assembly and the second plate assembly may be rotatable about the main body assembly. For example, the first plate assembly and the second plate assembly may be attached to the main body assembly by way of a hinge or the like. In some instances, the first plate assembly and the second plate assembly may be omitted.

A sight assembly may be operably attached to the main body assembly between the first plate assembly and the second plate assembly. For example, the sight assembly may be operably attached to a front portion or a back portion of the main body assembly between the first plate assembly and the second plate assembly. In some instances, the sight assembly may be rotatable about the main body assembly. For example, the sight assembly may be attached to the main body assembly by way of a hinge or the like.

In some instances, the sight assembly may include a sight assembly frame, a reflective lens positioned about the sight assembly frame, and a sight indication displayed on the reflective lens. In this manner, the sight assembly frame may be rotatably attached to the main body assembly, and the light source may display the sight indication on the reflective lens. In some instances, the sight indication may be adjustable about the sight assembly.

The firearm sight may include a deployment mechanism operable to deploy the first plate assembly, the second plate assembly, and the sight assembly from a closed position to an open position. In some instances, the deployment mechanism may be a spring or the like. In certain embodiments, the first plate assembly, the second plate assembly, and the sight assembly may comprise a substantially horizontal orientation in the closed position. The first plate assembly, the second plate assembly, and the sight assembly may be in the closed position when stowed. Conversely, the first plate assembly, the second plate assembly, and the sight assembly may comprise a substantially vertical orientation in the open position. The first plate assembly, the second plate assembly, and the sight assembly may be in the open position when aiming the firearm.

A latch assembly may be operably attached to the main body assembly. In some instances, the latch assembly may be configured to maintain the first plate assembly, the second plate assembly, and the sight assembly in the closed position. For example, the latch assembly may maintain the first plate assembly and the second plate assembly at least partially folded over the sight assembly in the closed position. Moreover, the latch assembly may maintain the first plate assembly and the second plate assembly at least partially folded over each other in the closed position. Manipulation of the latch assembly, in cooperation with the deployment mechanism, may deploy the first plate assembly, the second plate assembly, and the sight assembly to the open position.

These and other embodiments of the disclosure will be described in more detail through reference to the accompanying drawings in the detailed description of the disclosure that follows. This brief introduction, including section titles and corresponding summaries, is provided for the reader's convenience and is not intended to limit the scope of the claims or the proceeding sections. Furthermore, the techniques described above and below may be implemented in a number of ways and in a number of contexts. Several example implementations and contexts are provided with reference to the following figures, as described below in more detail. However, the following implementations and contexts are but a few of many.

Illustrative Embodiments

FIGS. 1-9 schematically depict various embodiments of a firearm sight 100 (as well as individual components of the firearm sight 100) that can be attached to a firearm in accordance with one or more embodiments of the disclosure. The firearm may be a conventional firearm. In some instances, the firearm may be a handgun. In other instances, the firearm may be a rifle. By way of example, the firearm may be any number of firearms, such as, but not limited to, an M-16 style rifle, an AR-15 style rifle, an AR-10 style rifle, an M-4 style rifle, or the like. In some instances, the firearm may be a shotgun. Any firearm may be used herein. In some instances, the firearm may include an attachment point, such as a rail, a groove, or a channel, for attaching the firearm sight 100.

In certain embodiments, the firearm sight 100 may include a main body assembly 102. The main body assembly 102 may house one or more components of the firearm sight 100. For example, the main body assembly 102 may include a light source and a power source, among other things. The light source and the power source may be at least partially housed within the main body assembly 102. Any optics system may be housed within the main body assembly 102. In some instances, the power source may be a battery. The main body assembly 102 may include an on/off switch 104 for activating the power source and light source. In some instances, the on/off switch 104 may be engaged by the thumb of a user grasping the firearm.

The main body assembly 102 may be attached to a firearm 106. For example, a mounting bracket assembly 108 may be used to mount the main body assembly 102 to the firearm 106. In some instances, the main body assembly 102 may be mounted to a slide 110 of a handgun 112. In certain embodiments, the slide 110 may include a channel 114 configured to at least partially mate with the mounting bracket assembly 108. One or more fasteners 116 may be used to secure the main body assembly 102 and the mounting bracket assembly 108 to the slide 110 of the handgun 112. In some instances, a bottom surface 118 of the main body assembly 102 may be contoured to correspond with the profile of the slide 110. In certain embodiments, the mounting bracket assembly 108 may be omitted.

In certain embodiments, the firearm sight 100 may include a first plate assembly 120 operably attached to the main body assembly 102. Moreover, a second plate assembly 122 may be operably attached to the main body assembly 102 opposite the first plate assembly 120. For example, the first plate assembly 120 and the second plate assembly 122 may be operably attached to opposing lateral sides of the main body assembly 102. In some instances, the first plate assembly 120 and the second plate assembly 122 may be omitted.

In some instances, the first plate assembly 120 and the second plate assembly 122 may be rotatable about the main body assembly 102. For example, the first plate assembly 120 and the second plate assembly 122 may be attached to the main body assembly 102 by way of a hinge 124. The hinge 124 may include a pair of slots 126 in the main body assembly 102. The slots 126 may include an aperture 128 therethrough. Moreover, the hinge 124 may include a pair of corresponding projections 130 extending from the first plate assembly 120 and the second plate assembly 122. The projections 130 may include apertures 131. In this manner, the projections 130 may mate with the corresponding slots 126. A pin 132 may be positioned within the aperture 128 within the slots 126 and the aperture 131 within the projections 130 to rotatably secure the first plate assembly 120 and the second plate assembly 122 to the main body assembly 102. Any number of rotatable configurations may be used herein.

A sight assembly 134 may be operably attached to the main body assembly 102 between the first plate assembly 120 and the second plate assembly 122. For example, the sight assembly 134 may be operably attached to a front portion 136 of the main body assembly 102 between the first plate assembly 120 and the second plate assembly 122.

In some instances, the sight assembly 134 may be rotatable about the main body assembly 102. For example, the sight assembly 134 may be attached to the main body assembly 102 by way of a hinge 138. The hinge 138 may include a pair of projections 140 extending from the main body assembly 102. Each of the projections 140 may include an aperture 142 therethrough. Moreover, the hinge 138 may include a pair of corresponding apertures 144 in the sight assembly 134. In this manner, the apertures 142 in the projections 140 may be aligned with the apertures 144 in the sight assembly 134. A pin 146 (or screws) may be positioned within the apertures 142 in the projections 140 and the apertures 144 in the sight assembly 134 to rotatably secure the sight assembly 134 to the main body assembly 102. Any number of rotatable configurations may be used herein.

In some instances, the sight assembly 134 may include a sight assembly frame 148. The sight assembly frame 148 may include the apertures 144 discussed above. The sight assembly 134 also may include a reflective lens 150 positioned about the sight assembly frame 148. The reflective lens 150 may be any suitable material. For example, in some instances, the reflective lens 150 may be at least partially transparent and may include a somewhat reflective surface. The properties of the reflective lens 150 may vary. A sight indication 152 may be displayed on the reflective lens 150. For example, the light source within the main body assembly 102 may project the sight indication 152 onto the reflective lens 150. In some instances, the sight indication 152 may be a red dot or the like. The sight assembly frame 148 may be rotatably attached to the main body assembly 102, and the light source may display the sight indication 152 on the reflective lens 150.

In some instances, the sight indication 152 may be adjustable about the reflective lens 150. For example, a user may calibrate the firearm sight 100 by adjusting the position of the sight indication 152 about the reflective lens 150. In some instances, a user may adjust the sight indication 152 up and down about the reflective lens 150 by manipulating the knob 154. For example, the knob 154 may be in communication with the light source so as to adjust the light source up and down. In other instances, a user may adjust the sight indication 152 left and right about the reflective lens 150 by manipulating the knob 156. For example, the knob 156 may be in communication with the light source so as to adjust the light source left and right. In some instances, the knob 154 and the knob 156 may be adjusted with a tool, such as a flathead screwdriver or the like.

The light source may include a light emitting diode, a tritium-powered light source, or any other source of suitable light. The light source can provide a constant source of light, or the light source may be switched between on and off depending on when the firearm sight 100 is in the open position or the closed position. The power or brightness of the light source may be adjusted automatically or manually. In some instances, the light source may be disposed about the main body assembly 102 opposite the sight assembly 134.

Figure 1:
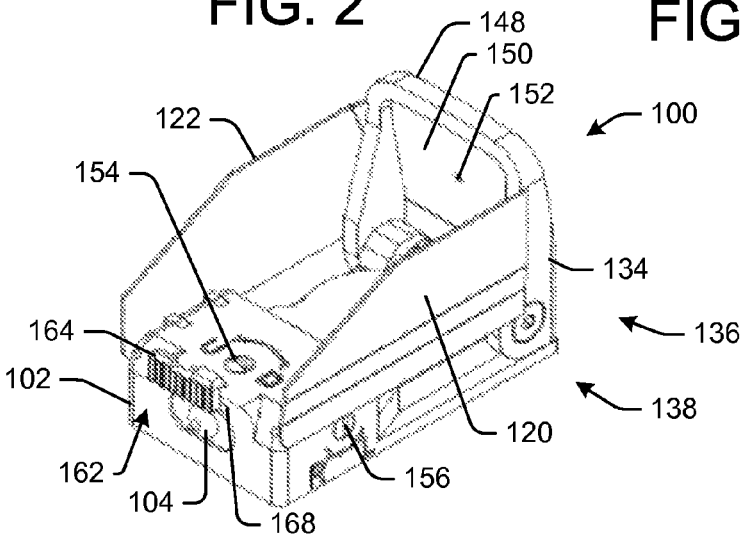
FIG. 1 schematically depicts a firearm sight in accordance with one or more embodiments of the disclosure.
Figure 4:
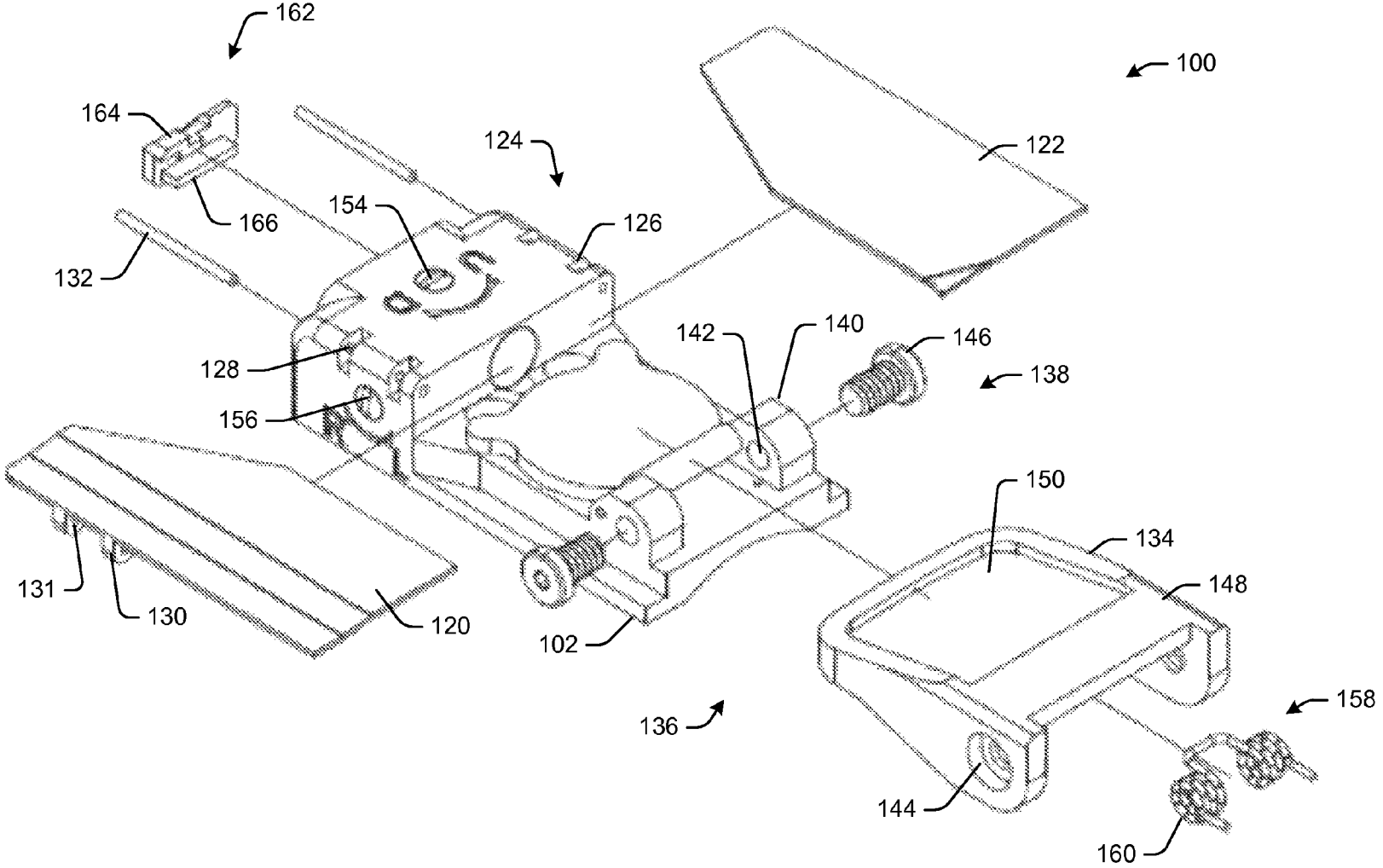
FIG. 4 schematically depicts a firearm sight in accordance with one or more embodiments of the disclosure.
Figure 5:
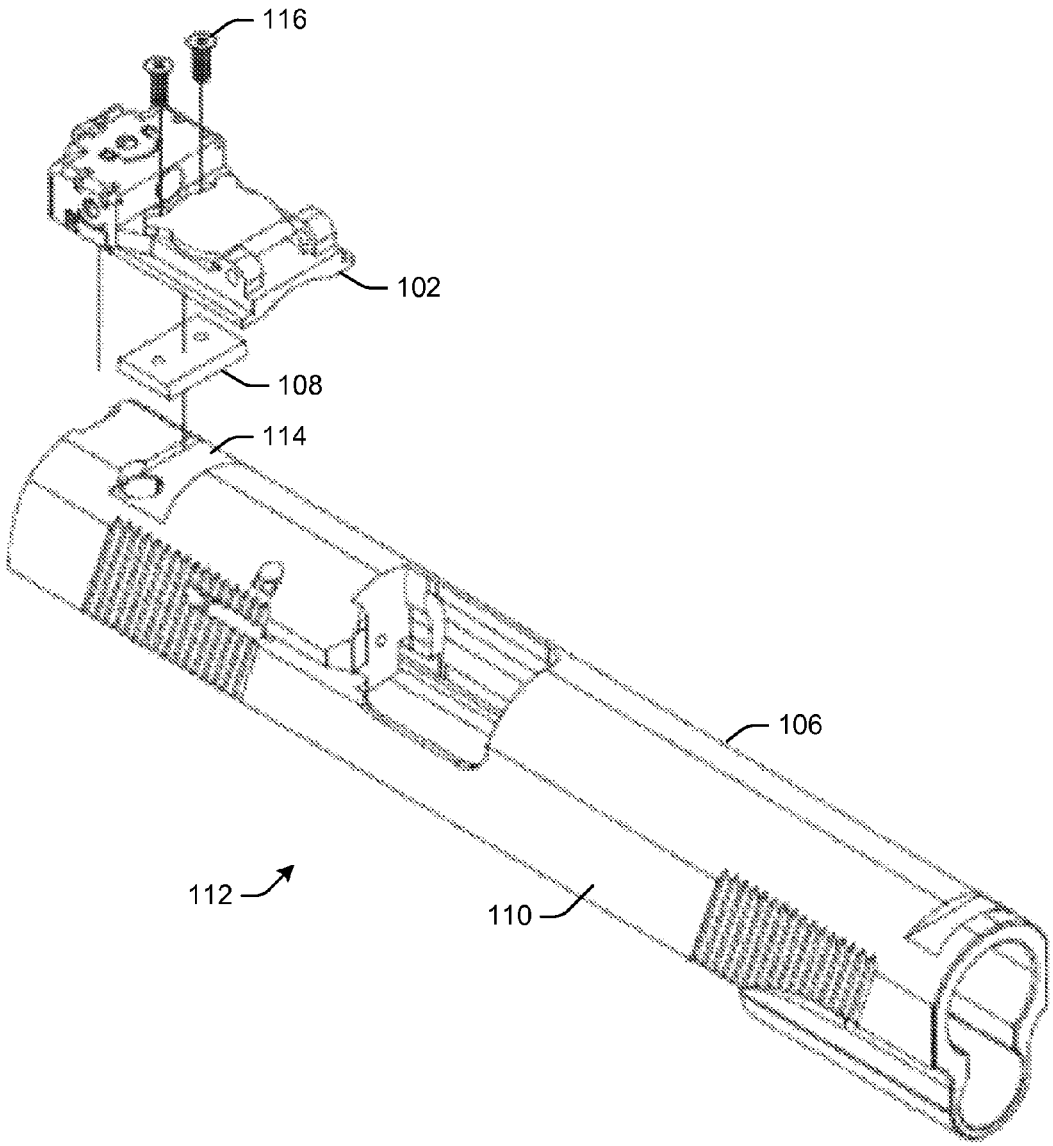
FIG. 5 schematically depicts a firearm sight in accordance with one or more embodiments of the disclosure.
Figure 6:
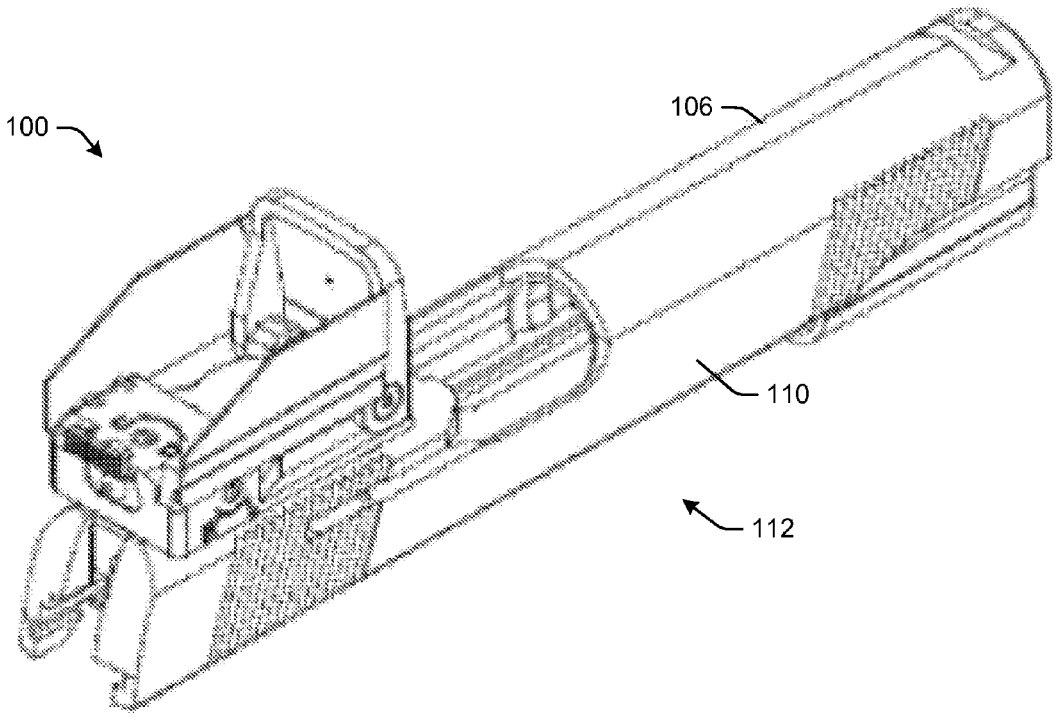
FIG. 6 schematically depicts a firearm sight in accordance with one or more embodiments of the disclosure.
Figure 7:
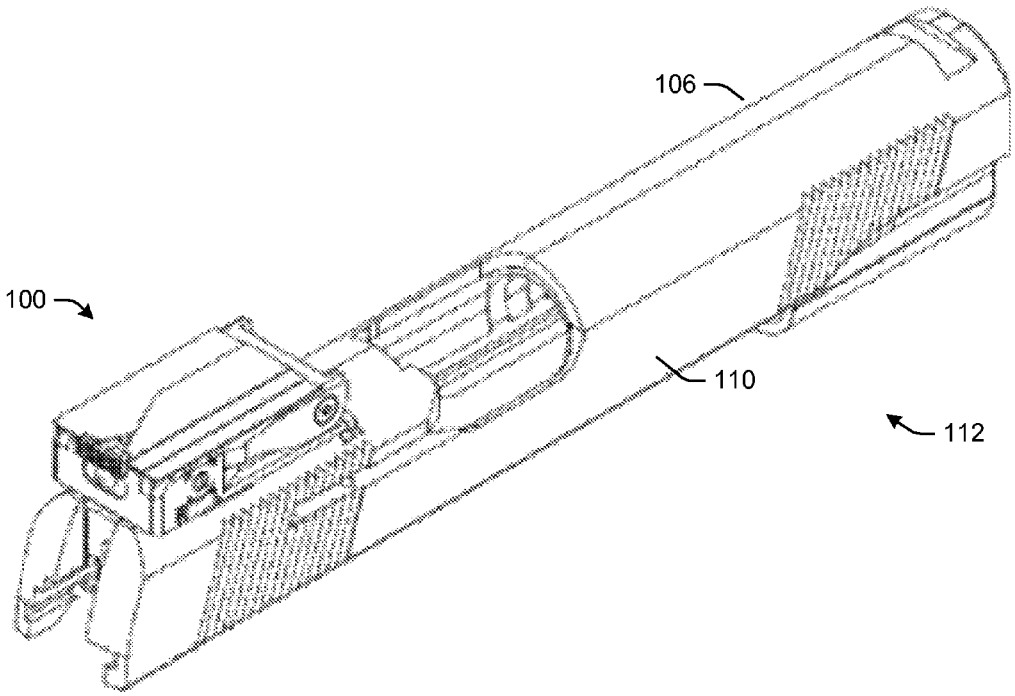
FIG. 7 schematically depicts a firearm sight in accordance with one or more embodiments of the disclosure.

The firearm sight 100 may include a deployment mechanism 158 operable to deploy the first plate assembly 120, the second plate assembly 122, and the sight assembly 134 from a closed position (as depicted in FIG. 2) to an open position (as depicted in FIG. 1). In some instances, the deployment mechanism 158 may be a spring or the like. For example, the deployment mechanism 158 may be a coil spring 160. The coil spring 160 may be positioned about the sight assembly 134 and the main body assembly 102. The coil spring 160 may bias the sight assembly 134 in the open position.

In certain embodiments, the first plate assembly 120, the second plate assembly 122, and the sight assembly 134 may comprise a substantially horizontal orientation in the closed position. When stowing the firearm sight 100, the first plate assembly 120, the second plate assembly 122, and the sight assembly 134 may be in the closed position. Conversely, the first plate assembly 120, the second plate assembly 122, and the sight assembly 134 may comprise a substantially vertical orientation in the open position. For example, the first plate assembly 120 and the second plate assembly 122 may be parallel to each other in the open position. Also in the open position, the sight assembly 134 may be transverse to the first plate assembly 120 and the second plate assembly 122. The first plate assembly 120, the second plate assembly 122, and the sight assembly 134 may be in the open position when aiming the firearm. In use, as the coil spring 160 moves the sight assembly 134 from the closed position to the open position, at least a portion of the first plate assembly 120 and the second plate assembly 122 may engage the sight assembly 134, which may move the first plate assembly 120 and the second plate assembly 122 from the closed position to the open position.

In some instances, the first plate assembly 120 and the second plate assembly 122 may provide stabilizing support for the sight assembly 134 in the open position. The firearm sight 100 may be moved to the closed position by rotating the sight assembly 134 from the vertical position to the horizontal position and then folding the first plate assembly 120 and the second plate assembly 122 over the sight assembly 134.

A latch assembly 162 may be operably attached to the main body assembly 102. In some instances, the latch assembly 162 may be configured to maintain the first plate assembly 120, the second plate assembly 122, and the sight assembly 134 in the closed position. For example, the latch assembly 162 may include a slidable lip 164 which may engage at least a portion of the first plate assembly 120 and the second plate assembly 122. The slidable lip 164 may include a protrusion 166 configured to mate with a slot 168 in the main body assembly 102. The latch assembly 162 may maintain the first plate assembly 120 and the second plate assembly 122 in a folded configuration over the sight assembly 134 in the closed position. Moreover, the latch assembly 162 may maintain the first plate assembly 120 and the second plate assembly 122 at least partially folded over each other in the closed position. In use, manipulation of the latch assembly 162, in cooperation with the deployment mechanism 158, may deploy the first plate assembly 120, the second plate assembly 122, and the sight assembly 134 to the open position. In some instances, the latch assembly 162 may be engaged by the thumb of a user grasping the firearm 106. In this manner, the firearm sight 100 may be deployed to the open position, and the power source may be activated by way of the on/off switch 104 in one motion.

Figure 8:
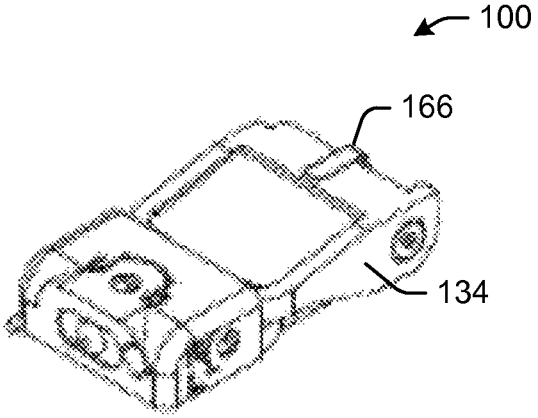
FIG. 8 schematically depicts a firearm sight in accordance with one or more embodiments of the disclosure.
Figure 9:
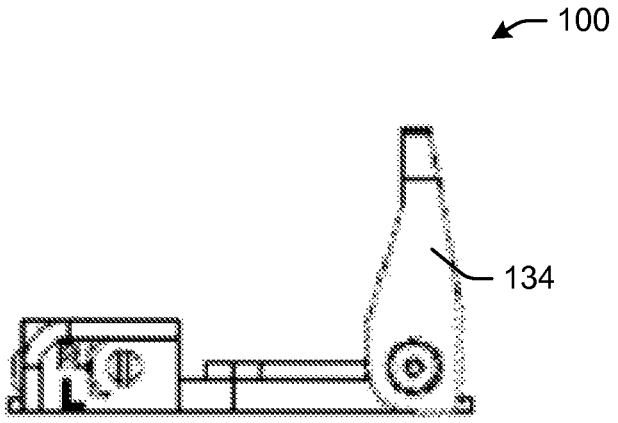
FIG. 9 schematically depicts a firearm sight in accordance with one or more embodiments of the disclosure.

As noted above, in certain embodiments, the first plate assembly 120 and the second plate assembly 122 may be omitted. For example, as depicted in FIGS. 8 and 9, the firearm sight 100 may include the sight assembly 134. The first plate assembly 120 and the second plate assembly 122, however, are omitted. Moreover, the latch assembly 162 may be omitted. In this manner, the sight assembly 134 may move between the closed position and the open position by way of the deployment mechanism 158. In some instances, a stabilizer/latch assembly 166 may cooperate with the deployment mechanism 158 to maintain the sight assembly 134 in the closed position and the open position.

Illustrative Methods

Figure 10:
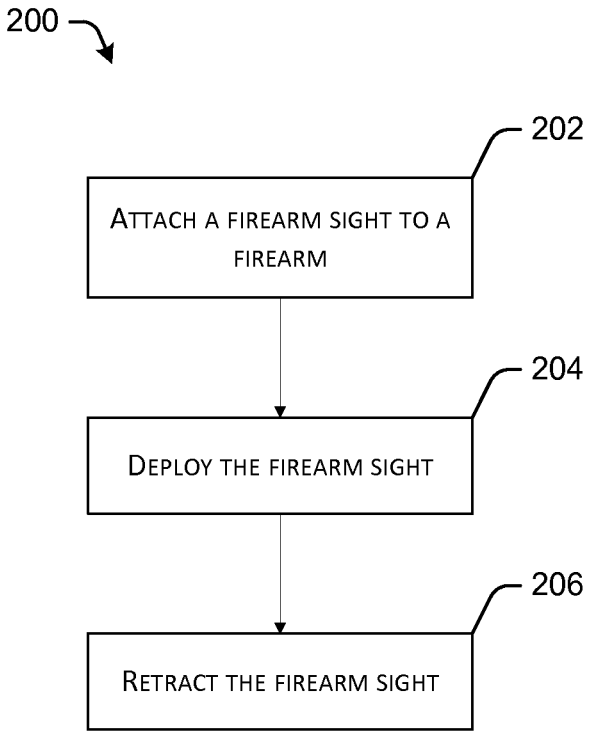
FIG. 10 is a flow diagram depicting an illustrative method for providing a firearm sight in accordance with one or more embodiments of the disclosure.

FIG. 10 is a flow diagram depicting an illustrative method 200 for providing the firearm sight 100 shown in FIGS. 1-9 in accordance with one or more embodiments of the disclosure. In certain embodiments, the firearm sight 100 may provide improved maneuverability and/or configurability. For example, the firearm sight 100 may be stowed and deployed with relative ease.

At block 202 of the method 200, the firearm sight 100 may be attached to a firearm. For example, the mounting bracket assembly 108 may be used to mount the main body assembly 102 to the firearm 106. In some instances, the main body assembly 102 may be mounted to the slide 110 of the handgun 112. In certain embodiments, the slide 110 may include a channel 114 configured to at least partially mate with the mounting bracket assembly 108. One or more fasteners 116 may be used to secure the main body assembly 102 and the mounting bracket assembly 108 to the slide 110 of the handgun 112. In some instances, the bottom surface 118 of the main body assembly 102 may be contoured to correspond with the profile of the slide 110. In certain embodiments, the mounting bracket assembly 108 may be omitted.

The firearm sight 100 may be deployed to the open position at block 204 of the method 200. For example, a user may manipulate the slidable lip 164 of the latch assembly 162 to disengage at least a portion of the first plate assembly 120 and/or the second plate assembly 122. With the latch assembly 162 disengaged, the deployment mechanism 158 may urge the sight assembly 134 from the closed position to the open position. As a result, the sight assembly 134 may engage at least one of the first plate assembly 120 and/or the second plate assembly 122, causing the first plate assembly 120 and the second plate assembly 122 to move from the closed position to the open position. Once in the open position, the light source may reflect the sight indication 152 on the reflective lens 150.

At block 206 of the method 200, the firearm sight 100 may be refracted to the closed position. For example, the sight assembly 134 may be rotated about the main body assembly 102 to the closed position. Next, the first plate assembly 120 and the second plate assembly 122 may be rotated about the main body assembly 102 from the open position to the closed position. The slidable lip 164 of the latch assembly 162 may engage at least a portion of the first plate assembly 120 and/or the second plate assembly 122 to maintain the firearm sight 100 in the closed position. In some instances, at least a portion of the first plate assembly 120 and the second plate assembly 122 may overlap in the closed position.

The operations described in blocks 202-206 of the method 200 may be performed in any order. Moreover, certain operations may be omitted, while other operations may be added.

Although specific embodiments of the disclosure have been described, numerous other modifications and alternative embodiments are within the scope of the disclosure. For example, any of the functionality described with respect to a particular device or component may be performed by another device or component. Further, while specific device characteristics have been described, embodiments of the disclosure may relate to numerous other device characteristics. Further, although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments may not include, certain features, elements, and/or operations. Thus, such conditional language is not generally intended to imply that features, elements, and/or operations are in any way required for one or more embodiments.

That which is claimed is:

1. A firearm sight, comprising:
- a main body assembly;
- a first plate assembly operably attached to the main body assembly;
- a second plate assembly operably attached to the main body assembly opposite the first plate assembly;
- a sight assembly operably attached to the main body assembly between the first plate assembly and the second plate assembly, wherein the sight assembly comprises:
  - a sight assembly frame;
  - a reflective lens positioned about the sight assembly frame; and
  - a sight indication displayed on the reflective lens;
- a deployment mechanism operable to deploy the first plate assembly, the second plate assembly, and the sight assembly from a closed position to an open position; and
- a latch assembly operably attached to the main body assembly and configured to maintain the first plate assembly, the second plate assembly, and the sight assembly in the closed position, wherein manipulation of the latch assembly, in cooperation with the deployment mechanism, deploys the first plate assembly, the second plate assembly, and the sight assembly to the open position.

2. The firearm sight of claim 1, further comprising at least one mounting bracket assembly configured to mount the main body assembly to a firearm.

3. The firearm sight of claim 1, wherein the main body assembly comprises a light source configured to display a sight indication on the sight assembly.

4. The firearm sight of claim 3, wherein the sight indication is adjustable about the sight assembly.

5. The firearm sight of claim 1, wherein the first plate assembly, the second plate assembly, and the sight assembly comprise a substantially horizontal orientation in the closed position.

6. The firearm sight of claim 5, wherein the first plate assembly and the second plate assembly are at least partially folded over the sight assembly in the closed position.

7. The firearm sight of claim 6, wherein the first plate assembly and the second plate assembly are at least partially folded over each other in the closed position.

8. The firearm sight of claim 1, wherein the first plate assembly, the second plate assembly, and the sight assembly comprise a substantially vertical orientation in the open position.

9. A firearm sight, comprising:
- a main body assembly attachable to a firearm;
- a first plate assembly rotatably coupled to the main body assembly;
- a second plate assembly rotatably coupled to the main body assembly opposite the first plate assembly;

a sight assembly rotatably coupled to the main body assembly between the first plate assembly and the second plate assembly, wherein the sight assembly comprises:

a sight assembly frame;

a reflective lens positioned about the sight assembly frame; and an adjustable sight indication displayable on the reflective lens;

a deployment mechanism operable to deploy the first plate assembly, the second plate assembly, and the sight assembly from a closed position to an open position; and a latch assembly operably attached to the main body assembly and configured to maintain the first plate assembly, the second plate assembly, and the sight assembly in the closed position, wherein manipulation of the latch assembly, in cooperation with the deployment mechanism, deploys the first plate assembly, the second plate assembly, and the sight assembly to the open position.

10. The firearm sight of claim 9, further comprising at least one mounting bracket assembly configured to mount the main body assembly to the firearm.

11. The firearm sight of claim 9, wherein the main body assembly comprises a light source configured to display an adjustable sight indication on the sight assembly.

12. The firearm sight of claim 9, wherein the first plate assembly, the second plate assembly, and the sight assembly comprise a substantially horizontal orientation in the closed position.

13. The firearm sight of claim 12, wherein the first plate assembly and the second plate assembly are at least partially folded over the sight assembly in the closed position.

14. The firearm sight of claim 13, wherein the first plate assembly and the second plate assembly are at least partially folded over each other in the closed position.

15. The firearm sight of claim 9, wherein the first plate assembly, the second plate assembly, and the sight assembly comprise a substantially vertical orientation in the open position.

16. A method for providing a firearm sight, comprising:

providing a main body assembly;

attaching a first plate assembly to the main body assembly;

attaching a second plate assembly to the main body assembly opposite the first plate assembly;

attaching a sight assembly to the main body assembly between the first plate assembly and the second plate assembly, wherein the sight assembly comprises:

a sight assembly frame;

a reflective lens positioned about the sight assembly frame; and a sight indication displayed on the reflective lens;

attaching a deployment mechanism to the main body assembly, wherein the deployment mechanism is configured to deploy the first plate assembly, the second plate assembly, and the sight assembly from a closed position to an open position; and attaching a latch assembly to the main body assembly, wherein the latch assembly is configured to maintain the first plate assembly, the second plate assembly, and the sight assembly in the closed position, wherein manipulation of the latch assembly, in cooperation with the deployment mechanism, deploys the first plate assembly, the second plate assembly, and the sight assembly to the open position.

* * * * *